US008294742B2

(12) United States Patent
Itou et al.

(10) Patent No.: US 8,294,742 B2
(45) Date of Patent: Oct. 23, 2012

(54) OPTICAL PRINTER HEAD AND IMAGE FORMING APPARATUS

(75) Inventors: Yuu Itou, Higashiomi (JP); Shinya Uchida, Higashiomi (JP)

(73) Assignee: Kyocera Corporation, Kyoto (JP)

( * ) Notice: Subject to any disclaimer, the term of this patent is extended or adjusted under 35 U.S.C. 154(b) by 87 days.

(21) Appl. No.: 12/740,103

(22) PCT Filed: Aug. 29, 2008

(86) PCT No.: PCT/JP2008/065578

§ 371 (c)(1),
(2), (4) Date: Aug. 5, 2010

(87) PCT Pub. No.: WO2009/057377

PCT Pub. Date: May 7, 2009

(65) Prior Publication Data

US 2011/0037826 A1 Feb. 17, 2011

(30) Foreign Application Priority Data

Oct. 30, 2007 (JP) ..... 2007-281249

(51) Int. Cl.
*B41J 2/44* (2006.01)

(52) U.S. Cl. ..... 347/130; 347/238

(58) Field of Classification Search ..... 347/130, 347/238

See application file for complete search history.

(56) References Cited

U.S. PATENT DOCUMENTS

| | | | | |
|---|---|---|---|---|
| 7,782,351 | B2 * | 8/2010 | Kurose et al. | 347/238 |
| 7,999,838 | B2 * | 8/2011 | Inoue et al. | 347/238 |
| 8,026,939 | B2 * | 9/2011 | Itou | 347/237 |
| 2007/0058180 | A1 | 3/2007 | Inoue et al. | 358/1.5 |
| 2010/0092214 | A1 * | 4/2010 | Itou | 399/220 |

FOREIGN PATENT DOCUMENTS

| | | | |
|---|---|---|---|
| JP | 04-094650 | | 8/1992 |
| JP | 4094650 | U | 8/1992 |
| JP | 07-195735 | | 8/1995 |
| JP | 2007-076021 | | 3/2007 |
| JP | 2009-056698 | * | 3/2009 |
| JP | 2009-154327 | * | 7/2009 |

OTHER PUBLICATIONS

Japanese language office action dated Jan. 24, 2012 and its English language translation issued in corresponding Japanese application 2009538972 cites the foreign patent document above.

* cited by examiner

*Primary Examiner* — Huan Tran
(74) *Attorney, Agent, or Firm* — DLA Piper LLP (US)

(57) ABSTRACT

An optical printer head comprises a base, a light-emitting device array mounted on the base, a lens array placed above the light-emitting device array; and a support member including a base bonding surface to which the base is bonded and a through hole, an opening of the through hole being positioned at the base bonding surface, wherein the base is bonded to the base bonding surface through an adhesive member and a part of the adhesive member is attached to an inner surface of the through hole.

13 Claims, 7 Drawing Sheets

(a)

(b)

OPTICAL PRINTER HEAD AND IMAGE FORMING APPARATUS

CROSS-REFERENCE TO THE RELATED APPLICATIONS

This application is a national stage of international application No. PCT/JP2008/065578, filed on Aug. 29, 2008 and claims the benefit of priority under 35 USC 119 to Japanese Patent Application No. 2007-281249, filed on Oct. 30, 2007, the entire contents of which are incorporated herein by reference.

FIELD OF THE INVENTION

The present invention relates to an optical head used as exposure means of an electrophotographic printer or the like, and to an image forming apparatus including the optical printer head.

BACKGROUND OF THE INVENTION

Some of image forming apparatuses, such as electrophotographic copiers and printers, include a printer head that includes an LED chip operable to emit light and a lens for forming an image in a predetermined position by using light emitted from the LED chip. In such an image forming apparatus, in order to form an exposed image as fine as possible on the surface of an electrophotographic photosensitive member, the surface of the electrophotographic photosensitive member has to be precisely aligned with the position where an image by using light from the optical printer head is formed. For example, Japanese Unexamined Patent Application Publication No. 7-195735 discloses an optical printer head including a mechanism for precisely aligning with the surface of an electrophotographic photosensitive member with a position where an image is formed by using light through a lens. The optical printer head disclosed in Japanese Unexamined Patent Application Publication No. 7-195735 includes, on the side of the optical printer head, pin-shaped projections projecting in the direction in which light from a light-emitting device travels. The projections come into contact with a reference member on the side of an image forming apparatus, so that the optical printer head is positioned in the image forming apparatus.

In the optical printer head disclosed in Japanese Unexamined Patent Application Publication No. 7-195735, however, the positioning pins are fixed to, for example, a base or heatsink on which a substrate provided with the LED chip is mounted. In the case of the optical printer head disclosed in Japanese Unexamined Patent Application Publication No. 7-195735, the pins have to be fixed outside a substrate mounting area in the base or heatsink. As thus the base or heatsink is relatively large, the size of the optical printer head is also relatively large.

In consideration of the above-described problem, it is an object of the present invention to provide a simple-structured optical printer head capable of setting both of the position of a light-emitting device in an image forming apparatus and the position of a lens array in the image forming apparatus with relatively high accuracy, and an image forming apparatus.

SUMMARY OF THE INVENTION

According to an embodiment of the present invention, an optical printer head includes a base, a light-emitting device array mounted on the base, a lens array placed over the light-emitting device array, and a support member including a base bonding surface to which the base is bonded and a lens array bonding surface to which the lens array is bonded and which is substantially perpendicular to the base bonding surface. The support member includes a through hole penetrating at the base bonding surface. The base is bonded to the base bonding surface via an adhesive member and a part of the adhesive member is fixed to the inner surface of the through hole.

According to another embodiment of the present invention, an optical printer head includes a base, a light-emitting device array mounted on the base, a lens array placed over the light-emitting device array, and a support member including a base bonding surface to which the base is bonded and a lens array bonding surface to which the lens array is bonded and which is substantially perpendicular to the base bonding surface. The support member includes a positioning hole for determining the attachment position of the optical printer head. The positioning hole is placed above the mounting surface of the base on which the light-emitting device array is mounted.

According to an embodiment of the present invention, an image forming apparatus includes an optical printer head including a base, a light-emitting device array mounted on the base, a lens array placed over the light-emitting device array, and a support member that includes a base bonding surface to which the base is bonded and a lens array bonding surface to which the lens array is bonded and which is substantially perpendicular to the base bonding surface. The support member includes a positioning hole for determining the attachment position of the optical printer head. The positioning hole is placed above the mounting surface of the base on which the light-emitting device array is mounted.

According to the above-described optical printer head and image forming apparatus, both of the position of the light emitting device in the image forming apparatus and the position of the lens array in the image forming apparatus can be set with relatively high accuracy. In addition, the above-described optical printer head can be made at a relatively low cost. Furthermore, the above-described optical printer head is constructed relatively compact and can form a high-definition image. In addition, the image forming apparatus is constructed relatively compact and can form a relatively high-definition image, though it is made at a relatively low cost.

BRIEF DESCRIPTION OF DRAWINGS

In FIG. 1, ground wire 13C is detached from the optical printer head 30;

In FIG. 4(*a*), for purpose of illustration, an electrophotographic photosensitive member 10, a head placement unit 13, and the optical printer head 30 are shown such that they are separated from one another;

FIG. 6(*b*) is a schematic cross-sectional view of the electrophotographic photosensitive member 10 taken along the line IIb-IIb shown in FIG. 6(*a*)

REFERENCE NUMERALS

Figure 1:
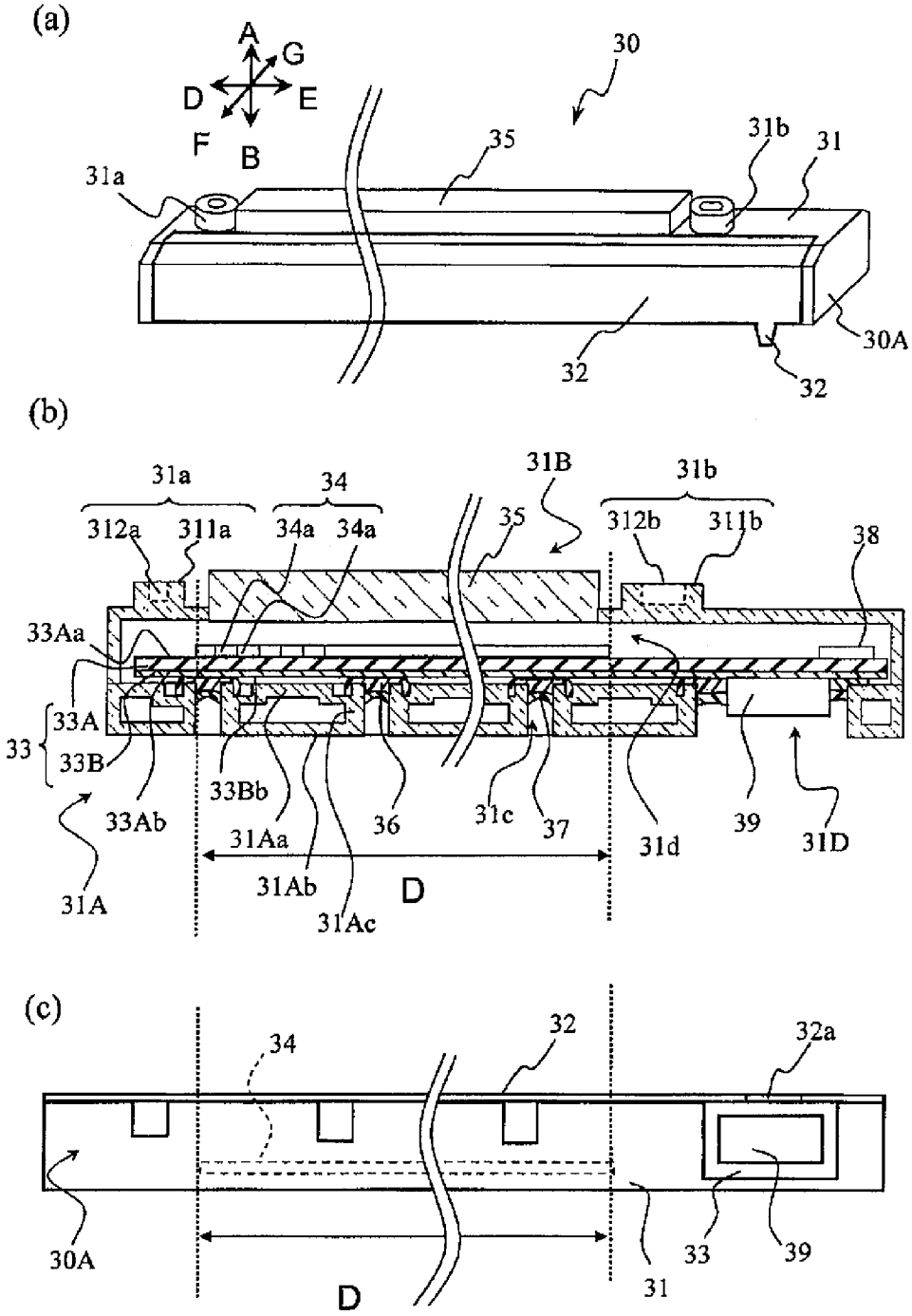
FIG. 1 is a diagram illustrating the schematic structure of an optical printer head 30, (a) being a perspective view thereof, (b) being a schematic side elevational view of the optical printer head 30 in a state in which a cover member 32 is detached. In addition, FIG. 1(*c*) is a diagram of the optical printer head 30 as viewed from the lower side of FIG. 1(*a*).
Figure 2:
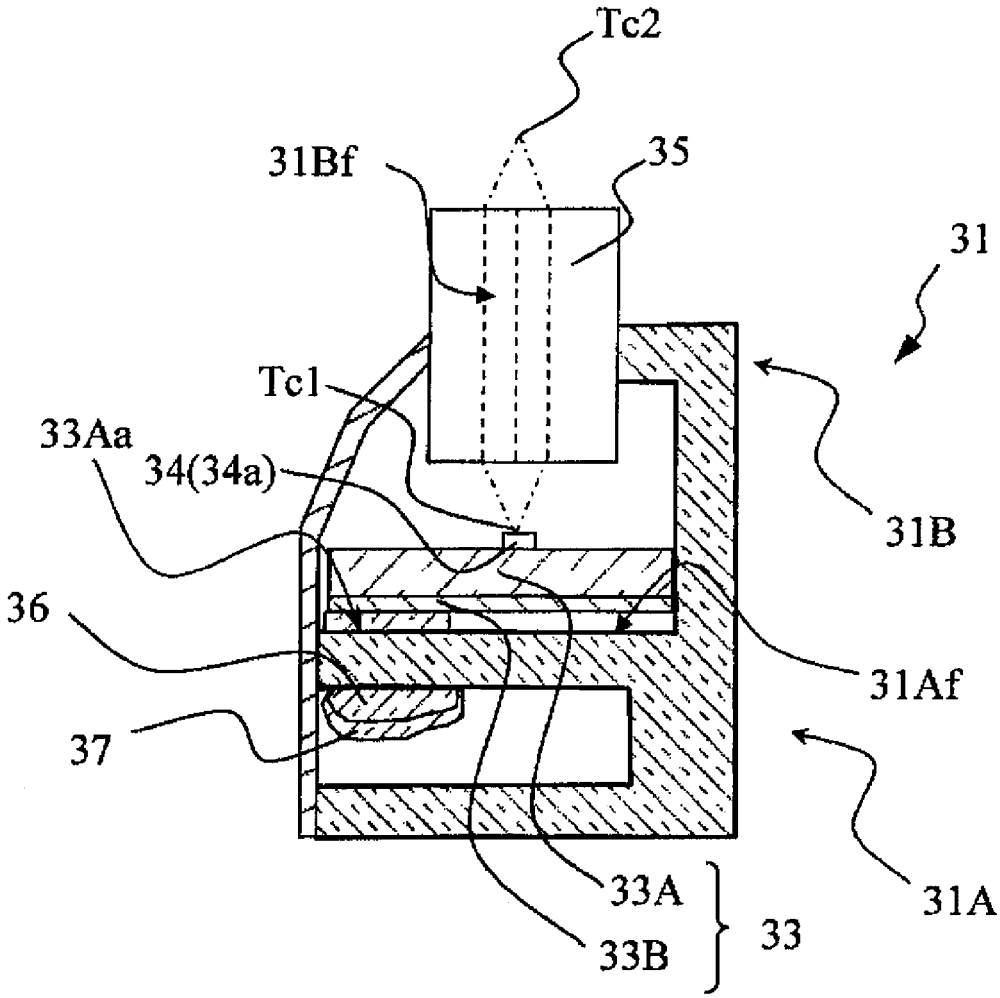
FIG. 2 is a schematic cross-sectional view of the optical printer head illustrated in FIG. 1.

1 apparatus body
10 electrophotographic photosensitive member
10*a* cylindrical base
10*b* photosensitive layer
12 charging unit
13 head placement unit
13A reference member
13B external force applying mechanism
13C ground wire
14 developing unit
14*a* developing sleeve
15 transfer unit
15*a* transfer charger
15*b* detach charger
16 fixing unit
16*a*, 16*b* fixing roller
17 cleaning unit
17*a* cleaning blade
18 discharging unit
30 optical printer head
30A housing
31 support member
31A base support portion
31Af base support surface
31B lens support portion
31Bf lens support surface
31*a*, 31*b* protrusion
32 cover member
32*a* projection
33 base
33A circuit board
33B base plate
34 light-emitting device array
34*a* light-emitting device
35 lens array
36 adhesive member
37 sealing member
38 driving IC
39 connector
311*a*, 311*b* reference surface
312*a*, 312*b* positioning hole

DETAILED DESCRIPTION OF THE INVENTION

An image forming apparatus and an optical printer head according to an embodiment of the present invention are concretely described below with reference to FIGS. 1 to 7. The optical printer head 30 includes a housing 30A formed by combining a support member 31 with a cover member 32, a base 33 including at least a plurality of light-emitting devices 34*a*, a driving IC 38 which serves as control means, and a connector 39, and a lens array 35 in which a plurality of lenses 35*a* for forming images in predetermined positions by using light emitted from the light-emitting devices 34*a* are arranged.

The support member 31 of the optical printer head 30 is a molding made of, for example, a resin material. The construction material of the support member 31 includes a resin material such as polyphenylene sulfide (PPS) or polycarbonate. In a case where the construction material of the support member 31 is a resin material, the support member 31 can more easily be shaped into a desired form by molding or the like. Furthermore, if the resin material includes glass fiber, the strength of the support member can be increased and the coefficient of linear expansion thereof can be reduced. On the other hand, the cover member 32 is made by performing sheet metal working on a metal material. The support member 31 is shaped to have one open side. The cover member 32 is placed so as to cover the open portion.

The support member 31 includes a base support portion 31A and a lens support portion 31B placed apart from the base support portion 31A. The support member 31 includes protrusions 31*a* and 31*b* provided on its outer surface, adhesive-member injection holes (through holes) 31*c*, and a receiving portion 31*d*.

The base support portion 31A has a base support surface 31Af. The base 33 is bonded to the base support surface 31Af. In addition, the lens support portion 31B has a lens support surface 31Bf. The lens array 35 is bonded to the lens support surface 31Bf.

The base support portion 31A of the support member 31 includes a first plate-shaped portion 31Aa on which the base 33 is mounted, a second plate-shaped portion 31Ab arranged substantially in parallel to the first plate-shaped portion 31Aa, and a plurality of beam-shaped portions 31Ac extending substantially perpendicular to the base mounting surface of the first plate-shaped portion 31Aa such that the beam-shaped portions 31Ac connects between the first plate-shaped portion 31Aa and the second plate-shaped portion 31Ab. The mechanical strength of the base support portion 31A is relatively high.

The base 33 fixed to the support member 31 includes a circuit board 33A and a base plate 33B on which the circuit board 33A is mounted, and a light-emitting device array 34 and the driving IC 38 are arranged on one principal surface 33Aa of the circuit board 33A. On the other principal surface 33Ab of the circuit board 33A, the connector 39 connected to the driving IC 38 is placed. Furthermore, the connector 39 provided for the base 33 is exposed through a connector placement through hole 31D of the support member 31.

The circuit board 33A has an elongated shape extending in the arrow DE direction. In the present embodiment, the circuit board 33A is formed in a substantially rectangular shape. The base plate 33B is a plate-shaped member made of, for example, a metal material. The rigidity of the base plate 33B, e.g., the flexural strength thereof is relatively higher than those of the circuit board 33A and the support member 31. The base plate 33B reinforces the strength of the circuit board 33A and also radiates heat generated by driving the light-emitting device array 34 to the outside of the optical printer head. The circuit board 33A and the base plate 33B are bonded by, for example, an adhesive tape or an adhesive. The circuit board 33A and the base plate 33B each have an elongated shape.

A plurality of the light-emitting device arrays 34 are provided on the principal surface 33Aa of the circuit board 33A on the upper side in the figures. The light-emitting device arrays 34 are arranged so that the light-emitting devices 34*a* are aligned in the lengthwise direction of the base 33. The light-emitting device 34*a* includes, for example, a light-emitting diode, a thyristor, an organic or inorganic electroluminescence (EL) element, or a liquid crystal shutter.

The driving IC 38, serving to control individual driving of the light-emitting devices 34*a* on the basis of image data supplied from the outside, is electrically connected to the light-emitting devices 34*a* through a conductive pattern of the circuit board 33A and is placed on the circuit board 33A.

The connector 39 is placed on the other principal surface 33Ab opposite the principal surface 33Aa on which the light-emitting device arrays 34 and the driving IC 38 are arranged. The connector 39 is placed in an area within, for example, 30 mm from one end of a placement area D of the light-emitting device arrays 34. In the present specification, providing the connector in the area within 30 mm from the end of the placement area D means that at least a part of the connector is included in a space region between one plane that passes the position at a distance of 30 mm from the end of the placement area D and is perpendicular to the surface of the circuit board 33A and another plane that passes the end of the placement area D and is perpendicular to the surface of the circuit board 33A. In addition, preferably, the distance between each of the protrusion 31*a* and 31*b* and the placement area D is as short as possible, for example, within 20 mm, more preferably, within 10 mm.

The base 33 is bonded to the base support portion 31A of the support member 31 with an adhesive member 36. The adhesive member 36 includes, for example, cyanoacrylate or an acrylic or epoxy resin adhesive. The adhesive member 36 is injected into the space between the base support surface 31Af of the base support portion 31A and one principal surface 33Bb of the base plate 33B, on the lower side in the figures, to bond the base 33 and the support member 31. If the adhesive member 36 comprises, for example, a heat-curable resin adhesive, the adhesive is injected through the adhesive-member injection holes (through holes) 31*c* in the support member 31A toward the principal surface 33Bb, on the lower side in the figures, of the base plate 33B and is spread in the space between the base support portion 31A and the base plate 33B and is then cured with heat, thus forming the adhesive member 36. The thickness of the adhesive member 36 is set to a value greater than a maximum height $R_{max}$ of the base support surface 31Af of the support member 31. This reduces deviations in the position of the base 33 relative to the support member 31 due to the surface form (unevenness) of the base support surface 31Af, thus reducing shifts from a set state in the positions of reference surfaces 311*a* and 311*b* of the support member 31 relative to the light-emitting devices 34 on the base 33 depending on the surface form (unevenness) of the base support surface 31Af. In this case, the maximum height $R_{max}$ is a value measured by a measuring method defined in JIS B0601-1994 in conformity with ISO 468-1982.

A sealing member 37 seals the adhesive-member injection holes 31*c* to block light emitted from the light-emitting devices 34. In the present embodiment, the sealing member 37 reinforces the adhesive member 36 positioned in the adhesive-member injection holes 31*c* and also has a function of maintaining the adhesion between the base 33 and the support member 31. In addition, the sealing member 37 is provided to the inside of the connector placement through hole 31D so as to close the connector placement through hole 31D of the support member 31. The construction material of the sealing member 37 includes, for example, an epoxy or silicone resin material. If the sealing member 37 comprises heat-curable resin, the liquid resin is injected through the adhesive-member injection holes 31*c* and is allowed to adhere to the surface of the adhesive member 36 and a part of the inner surface of each adhesive-member injection hole 31*c* and is then cured with heat, thus forming the sealing member 37. In a case where the sealing member 37 is an elastic member, for example, even when heat is generated by light emission of the light-emitting devices 34, the sealing member 37 can relax a stress accompanying heat expansion and it is preferable in reducing shifts in the position of the light-emitting devices or the like at the time of light emission.

In the support member 31, the lens support portion 31B includes the protrusions 31*a* and 31*b*. The protrusions 31*a* and 31*b* have the reference surfaces 311*a* and 311*b* and positioning holes 312*a* and 312*b*, respectively.

The protrusions 31*a* and 31*b* are arranged in portions outside the placement area D in the lengthwise direction so as to have the placement area D for the light-emitting devices 34*a* therebetween, as shown in the figures. The projection 31*b* is placed in the portion corresponding to the space between the placement area D for the light-emitting device array 34 and the connector 39. In the support member 31, as viewed from the side in the direction in which light from the light-emitting devices travels, at least part of the circuit board 33A on the base support portion 31A overlaps each of the protrusions 31*a* and 31*b* of the lens support portion 31B.

The reference surfaces 311*a* and 311*b* serve as position references of the optical printer head 30 in the direction indicated by the arrow AB direction in an image forming apparatus X (refer to FIG. 5), which the optical printer head 30 is placed in and which is described later. More specifically, they serve as the position references in the direction along the optical axes of the lenses 35 in the support member 31 in the image forming apparatus X including an electrophotographic photosensitive member 10, and further serve as position references for one focus Tc2 of each lens 35*a* in the image forming apparatus X. The position of the above-described one focus Tc2 in the image forming apparatus X is the position where an image is formed by using light from each light-emitting device 34*a* in the image forming apparatus X. These reference surfaces 311*a* and 311*b* have a relatively high flatness. In this case, the flatness denotes a normal tolerance defined in JIS Standard B0021:1984 in conformity with ISO Standards 1101. In the present embodiment, the normal tolerance is set to, for example, be equal to or greater than $0.1\times10^{-1}$ and be equal to or less than 0.5.

The positioning holes 312*a* and 312*b* function as arrangement index parts which serve as indices for the support member 31 in the arrow DE direction. In the present embodiment, the positioning holes 312*a* and 312*b* are provided so as to have the placement area D for the light-emitting devices 34*a* in the optical printer head 30 therebetween, and also function as indices for the arranging direction of the light-emitting devices 34*a* arranged in the placement area D. In the present embodiment, the positioning hole 312*b* has a longitudinal axis as viewed in the arrow AB direction, and the axial direction is along the arrow DE direction.

In the optical printer head 30, the positioning holes 312*a* and 312*b* are arranged on the upper side of the principal surface 33Aa of the base 33. In the optical printer head 30, the positioning holes 312*a* and 312*b* are arranged in an area corresponding to the principal surface 33Aa of the base 33, so that the optical printer head is made more compact as compared with a case where the position references are provided outside the area corresponding to the principal surface 33Aa of the base 33. In this case, "upper side" means the side from the one principal surface 33Aa of the base 33 toward the lens array 35. The positioning holes in the present invention may penetrate the support member or may not.

The lens array 35 includes a plurality of lenses 35*a* arranged and focuses light emitted from each light-emitting device 34*a* of the light-emitting device array 34 on a predetermined image forming position. The lenses 35*a* are arranged in the arrow DE direction. The lens array 35 is positioned and fixed to the lens support portion 31B of the support member 31 so that each light-emitting device 34*a* is positioned at one focus Tc1 of two focuses Tc1 and Tc2 of the corresponding lens 35*a*. More specifically, the lens array 35 is positioned relative to the reference surfaces 311*a* and 311*b* of the support member 31 so that predetermined positional relationship with the reference surfaces 311*a* and 311*b* of the support member 31 is established and the light-emitting devices 34 on the base 33 fixed to the support member 31 are positioned at the focuses Tc1 of the lens array 35, and the lens array 35 is bonded and fixed to the lens support surface 31Bf of the support member 31.

In the optical printer head 30, the light-emitting devices 34*a* are arranged on the circuit board 33A, and the circuit board 33A and the lenses 35 to focus light from the light-emitting devices 34*a* on predetermined image forming positions are fixed to the single support member 31. The support member 31 has the protrusions 31*a* and 31*b* for positioning. With such a structure, since both of the circuit board 33A on which the light-emitting devices 34*a* are arranged and the lenses 35 are directly provided on the support member 31, the mutual positional relationship between the light-emitting devices 34*a* and the lenses 35 can be set with high accuracy. Accordingly, when the optical printer head 30 is placed in the image forming apparatus X (refer to FIG. 5) which is described later, the accuracies of both of the position of each light-emitting device 34*a* in the image forming apparatus X and the position of each lens 35 in the image forming apparatus X can be simultaneously ensured. Furthermore, the image forming position of light from each light-emitting device 34*a* can be positioned on the surface of a photosensitive layer 10*b* in the image forming apparatus X with high accuracy.

The cover member 32 is placed so as to close an opening of the support member 31 in which the circuit board 33A and the lens array 35 are arranged. The cover member 32 is bonded and fixed to the support member 31 with, for example, an adhesive. Since the cover member 32 is made of, for example, a metal material, the conductivity thereof is relatively higher than the support member 31 made of a resin material. The cover member 32 is provided with a projection 32*a* projecting to the side where the connector 39 is exposed in the optical printer head 30. The projection 32*a* is connected to a ground wire (not illustrated) provided for the image forming apparatus X. The cover member 32 is a continuous plate-shaped member extending in the direction (arranging direction) in which the light-emitting devices 34*a* are arranged in the circuit board 33A. The cover member 32 is provided in contact with the support member 31 so as to cover all of the light-emitting devices 34*a*.

In a relatively small image forming apparatus, the distance between the optical printer head 30 and, for example, a charging unit 12 which is described later is relatively short. If charge generated by the charging unit 12 or the like flows into the optical printer head 30, the flowing charge flows to ground through the cover member 32. In the optical printer head 30, the flow of charge to the circuit board 33A can be reduced in the entire circuit board 33A. In the optical printer head 30 according to the present embodiment, the amount of accumulated electricity can be controlled small, thereby reducing malfunction of the driving IC 38 or the light-emitting device array 34 and damage thereon.

In the optical printer head 30, the projection 32*a* of the cover member 32 is placed outside each of the placement area D and the protrusion 31*b* in the lengthwise direction. Accordingly, if some external force is applied to the projection 32*a* during an operation of attaching or detaching a terminal 13$C_2$ connected to a ground wire 13$C_1$ of the image forming apparatus X to/from the projection 32*a*, the effect of this external force on the light-emitting device array 34 in the placement area D can be controlled relatively small. Consequently, in the optical printer head 30, the distortion or twist of the placement area D for arranging the light-emitting device array 34 is reduced and shifts in the focusing positions of the lens array 35 is also reduced.

In the optical printer head 30, the support member 31 includes the base support portion 31A, the lens support portion 31B, the protrusions 31*a* and 31*b*, the connector placement through hole 31D and the like, and thus has a relatively complicated shape. In the optical printer head 30, the support member 31 having such a complicated shape is made at a relatively low cost by molding a resin material. On the other hand, the cover member 32 that allows charge flowing from the charging unit 12 or the like to escape to the ground has a relatively simple shape with little irregularities. The cover member 32 can be made at a relatively low cost by performing, for example, sheet metal working on a metal material. In other words, the optical printer head 30 according to the present embodiment has a relatively low-cost structure while ensuring a relatively high accuracy of form, i.e., keeping the image forming positions of light with a relatively high accuracy.

In the present embodiment, the optical printer head 30 is placed in the image forming apparatus X. The image forming apparatus X includes a reference member 13A, and an external force applying mechanism 13B.

Figure 3:
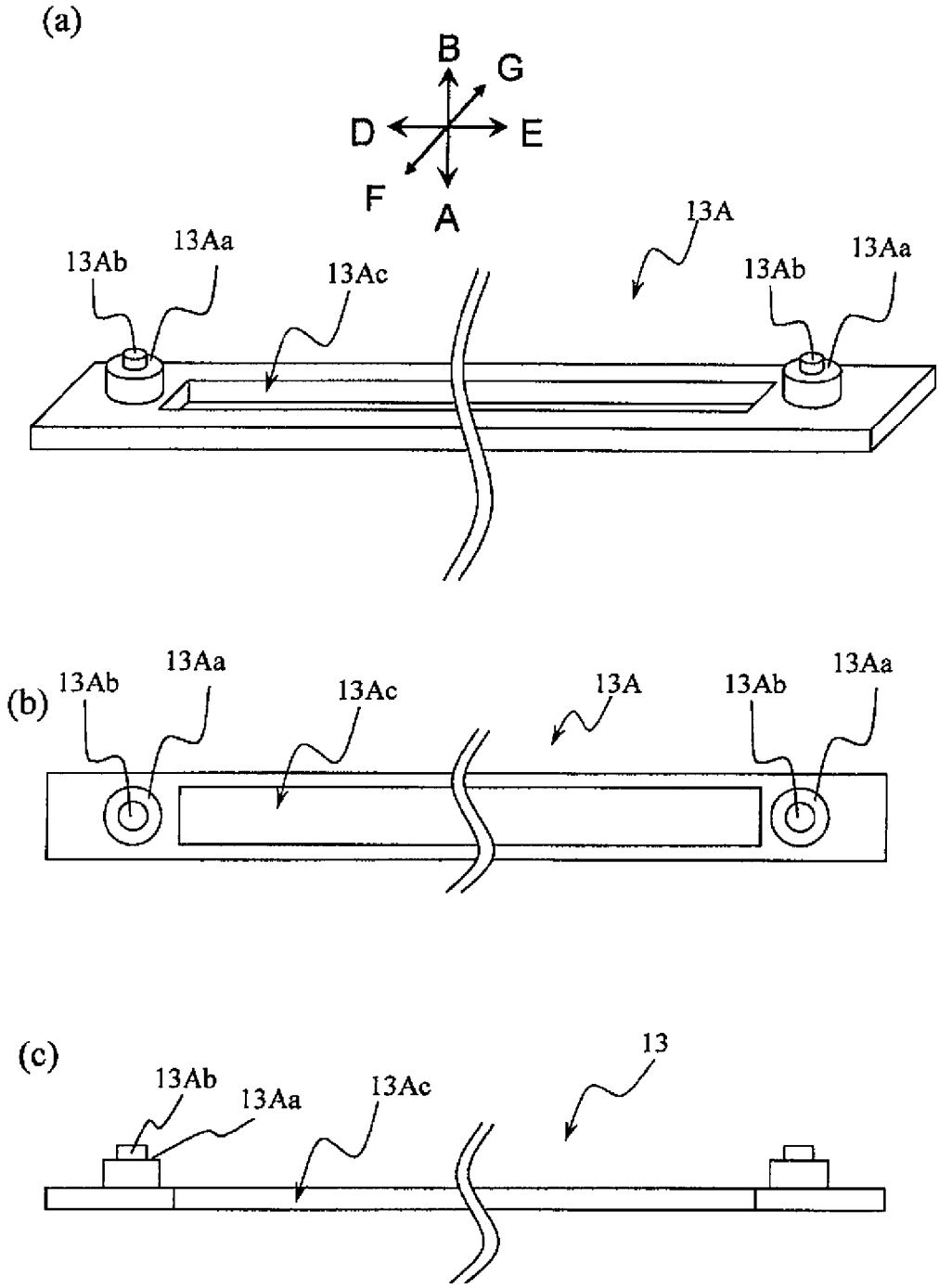
FIG. 3 is a diagram illustrating the schematic structure of a reference member 13A provided for an image forming apparatus X, (a) being a perspective view of the reference member 13A, (b) being a plan view of the reference member 13A, (c) being a side elevational view of the reference member 13A.
Figure 4:
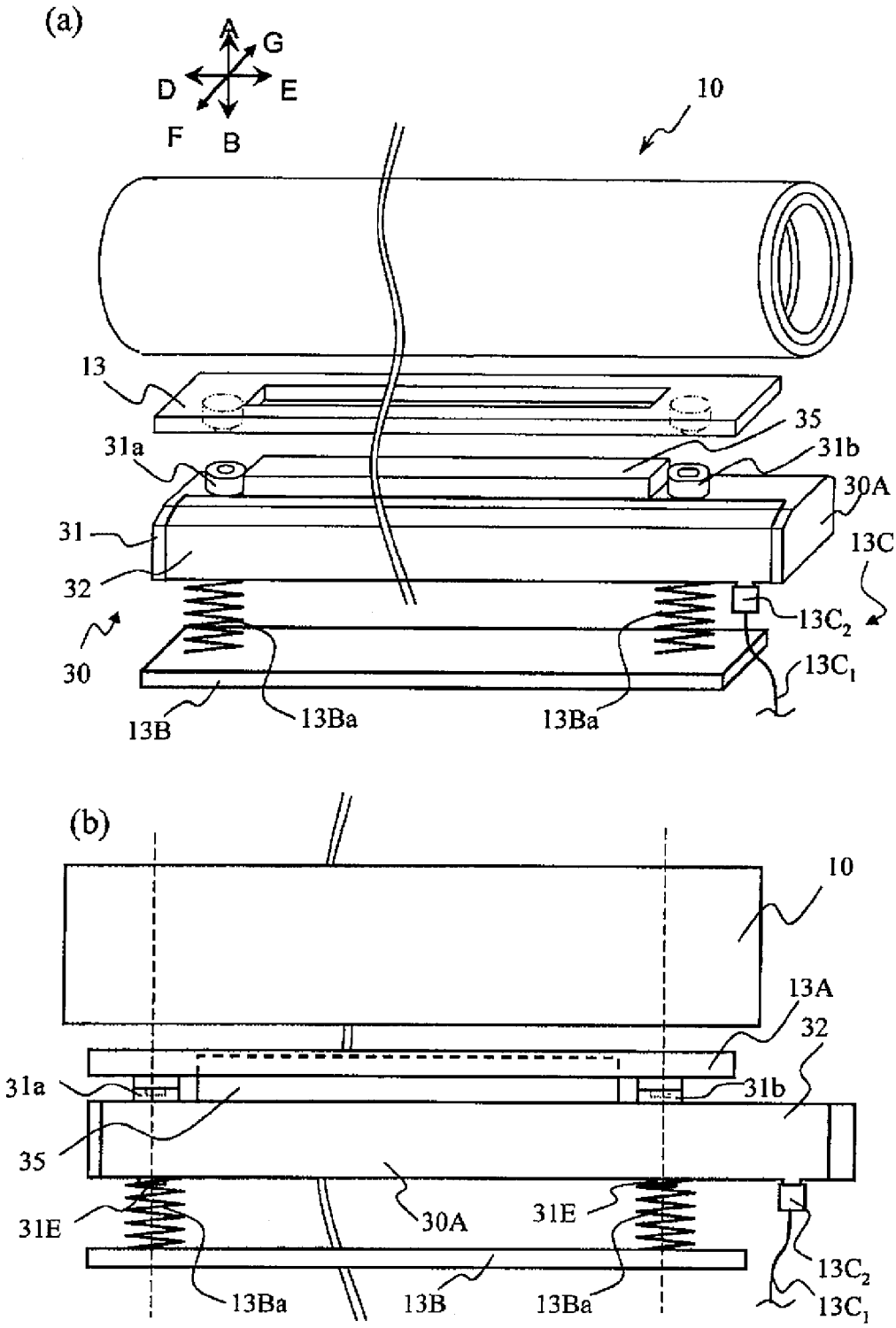
FIG. 4 is a diagram illustrating a state in which the optical printer head 30 is placed in an image forming apparatus body (the image forming apparatus X described later), FIG. 4(*a*) being a schematic perspective view, FIG. 4(*b*) being a schematic side elevational view.

Referring to FIG. 3, the reference member 13A includes contact surfaces 13Aa, insertion bosses 13Ab, and an opening 13Ac. The reference member 13A is placed in a space between the electrophotographic photosensitive member 10 and the optical printer head 30. Referring to FIG. 4, a head placement unit 13 includes the reference member 13A, the external force applying mechanism 13E, and ground wire 13C.

In the image forming apparatus X, the placement position of the optical printer head 30 is set in an apparatus body 1 of the image forming apparatus X by bringing the protrusions 31*a* and 31*b* of the optical printer head 30 into contact with the reference member 13A fixed to the apparatus body 1 of the image forming apparatus X. The external force applying mechanism 13B applies an external force in the direction along the optical axis of each lens 35*a* of the lens array 35 to each external force application region set in the optical printer head 30. The external force applying mechanism 13B includes two springs 13Ba. Each spring 13Bb applies an external force to the external force application region in the optical printer head 30. The external force application regions in the optical printer head 30 are arranged in areas of the support member 31, which are positioned on the rear surface opposed to the base support surface 31Af and correspond to the positioning protrusions 31*a* and 31*b*. In the present embodiment, the regions are set in predetermined areas, intersecting perpendicular lines (dash lines in FIG. 4*b*) dropped from the positioning protrusions 13*a* and 13*b* to the one principal surface 33A of the circuit board 33, on the rear surface opposite the base support surface 31Af. On the rear surface of the support member 31, projections 31E are provided in portions corresponding to the external force application regions. These projections 31E serve as position references which the springs 13Ba are brought into contact with and also prevent displacement of the springs 13Ba.

As shown in FIGS. 1, 3, 4(*b*), the contact surfaces 13Aa are in contact with the reference surface 311*a* of the protrusion 31*a* and the reference surface 311*b* of the protrusion 31*b* provided in the support member 31 constituting the optical printer head 30 to determine the position of the optical printer head 30 in the image forming apparatus X. More specifically, the position of the support member 31 in the direction along the optical axis of each lens 35*a* are determined. Furthermore, the position of the other focus Tc2 of each lens 35*a* is determined in the image forming apparatus X. In the present embodiment, the reference member 13A is previously set in a predetermined position in the apparatus body 1 so that the other focus Tc2 is positioned on the surface of the photosensitive member layer 10*b* of the electrophotographic photosensitive member 10.

The insertion bosses 13Ab are inserted in the positioning hole 312*a* of the protrusion 31*a* and the positioning hole 312*b* of the protrusion 31*b* in the support member 31 of the optical printer head 30 to set the positions of the protrusions 31*a* and 31*b* in the direction perpendicular to the above-described optical axis direction, and further to determine the arranging direction of the light-emitting devices 34*a* and the arranging direction of the lenses 35*a* in the image forming apparatus X. In the present embodiment, the reference member 13A is previously placed in the apparatus body 1 so that the arranging direction of the light-emitting devices 34*a* and that of the lenses 35*a* is substantially oriented in the direction along the axis of the electrophotographic photosensitive member 10. The opening 13*c* allows light emitted from the optical printer head 31 to pass and is formed in an area facing the lens array 35.

In the optical printer head 30, one protrusion has both of an optical axis position determining surface (311*a* and 311*b*) for determining the position in the optical axis direction and a horizontal position determining portion (312*a* and 312*b*) for determining the position in the direction substantially perpendicular to the optical axis. The relatively small protrusion alone can set the three-dimensional position of the optical printer head 30 in the image forming apparatus X with high accuracy. Furthermore, the optical printer head 30 and the image forming apparatus X can be made relatively compact and a relatively high-definition image can be formed.

In addition, the image forming apparatus X, in which the optical printer head 30 is placed, includes the reference member 13A and the external force applying mechanism 13B. The image forming apparatus X can maintain a good state of contact between the positioning protrusions 13*a* and 13*b* of the optical printer head 30 and the reference member 13A of the image forming apparatus X to keep the image forming positions of light emitted from the optical printer head 30 in the image forming apparatus X with relatively high accuracy. In the image forming apparatus X, external forces are applied to only the portions outside the placement area D for the light-emitting device array 34 in the placed optical printer head 30. In addition, in the image forming apparatus X, external forces are applied to only the portions outside the placement area D for the light-emitting device array 34 even during the operation of attaching or detaching the connector, as described above. Specifically, an external force which may cause movement or distortion of the placement area D for the light-emitting device array 34 in the optical printer head 30 is less likely to be applied in the image forming apparatus X in which the optical printer head 30 is placed. Consequently, fluctuation of the image forming positions of light emitted from the optical printer head 30 in the image forming apparatus X is reduced, so that a relatively high-quality image can be formed. The image forming apparatus X of the present invention can form an image with relatively high definition, though it is manufactured at a relatively low cost.

Figure 5:
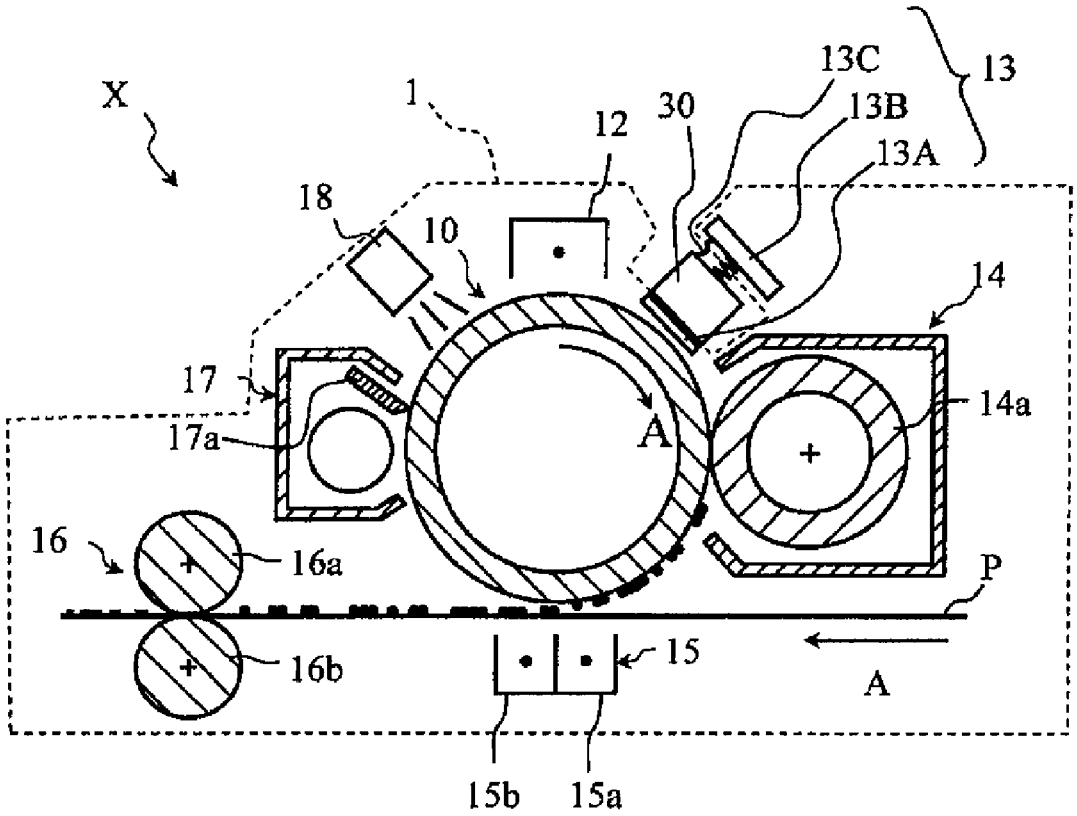
FIG. 5 is a diagram illustrating the schematic structure of the image forming apparatus X as an embodiment of an image forming apparatus according to the present invention, the image forming apparatus including an optical printer head of the present invention.

The image forming apparatus X shown in FIG. 5 is constructed such that the optical printer head 30 is placed in the apparatus body 1 including the electrophotographic photosensitive member 10, the charging unit 12, the head placement unit 13, a developing unit 14, a transfer unit 15, a fixing unit 16, a cleaning unit 17, and a discharging unit 18.

Figure 6:
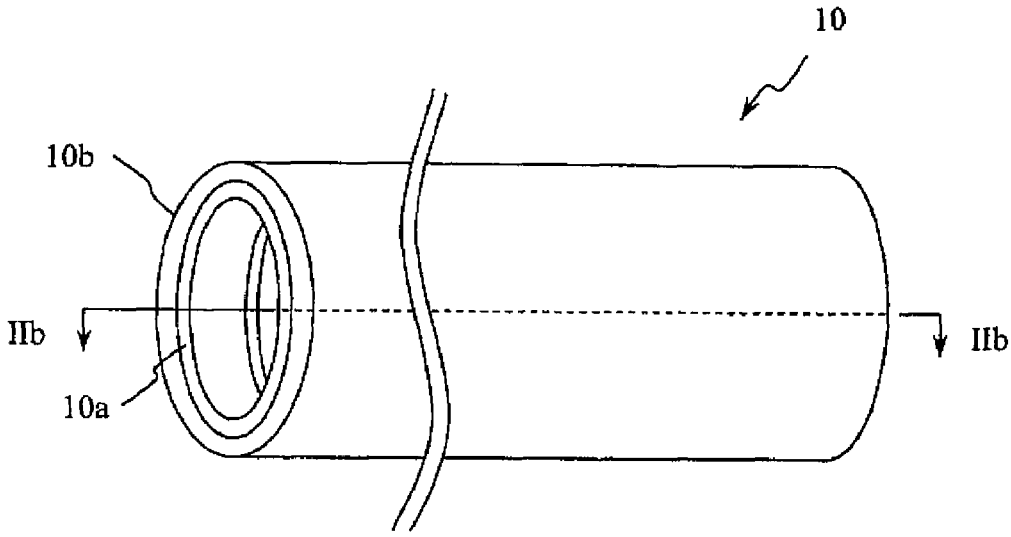
FIG. 6(*a*) is a schematic perspective view of the electrophotographic photosensitive member 10.
Figure 6:
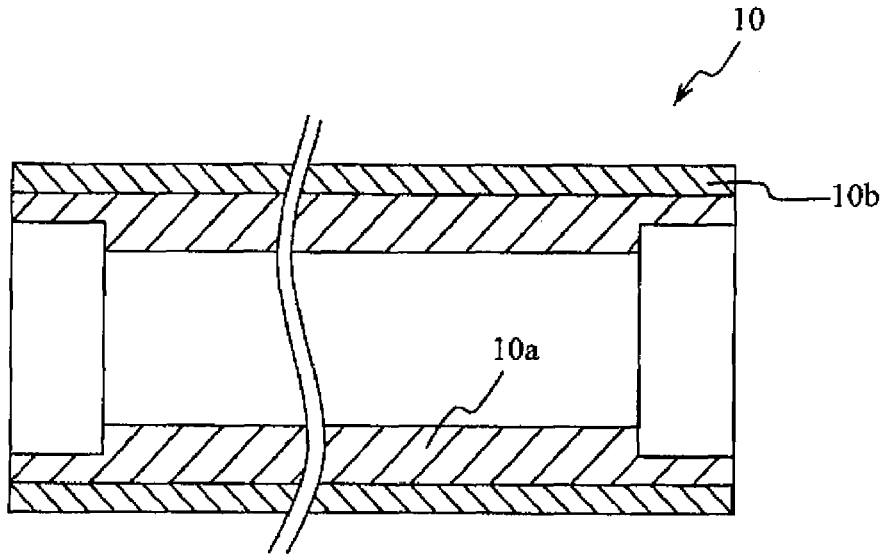

As shown in FIG. 6, the electrophotographic photosensitive member 10 on which an electrostatic latent image based on an image signal and a toner image are to be formed is rotatable in the arrow A direction in FIG. 5. As also shown in FIG. 6, the electrophotographic photosensitive member 10 is constructed such that the photosensitive layer 10*b* is formed on the outer surface of a cylindrical base 10*a*.

The cylindrical base 10*a* has conductivity on at least the surface and is made of, for example, aluminum.

The photosensitive layer 10*b* has a structure comprising a covering photoconductive layer made of inorganic semiconductor or organic semiconductor, such as amorphous silicon. When the photoconductive layer is irradiated with light from the optical printer head 30, the specific resistance of the photoconductive layer is sharply lowered to form a predetermined latent image on the photoconductive layer. The photosensitive layer 10*b* may include a carrier injection blocking layer for blocking injection of carriers from the cylindrical base 10*a* and a surface coat for protecting the surface of the electrophotographic photosensitive member 10.

The charging unit 12 uniformly charges the surface of the electrophotographic photosensitive member 10 positively or negatively in accordance with the type of photoconductive layer. The charging unit 12 charges the surface of the electrophotographic photosensitive member 10 at, for example, 100 to 1000 V by, for example, high-voltage corona discharge. The image forming apparatus X is made relatively small and the distance between the optical printer head 30 and the charging unit 12 is relatively short.

The optical printer head 30 irradiates the surface of the electrophotographic photosensitive member 10 (the photosensitive layer 10*b*) with light on the basis of a driving signal in order to form an electrostatic latent image on the surface of the electrophotographic photosensitive member 10.

The electrophotographic photosensitive member 10 is fixed to a predetermined position in the apparatus body 1 of the image forming apparatus X. The reference member 13A is fixed to a specific position relative to the electrophotographic photosensitive member 10.

The image forming apparatus X includes control means which includes, for example, a computer (not illustrated) including a CPU, a memory, and the like and which controls the operation of the entire image forming apparatus X. The control means converts an image signal supplied from outside of the image forming apparatus X into a signal for driving the optical printer head 30 and outputs the signal to the optical printer head 30. In addition, the control means is connected to the electrophotographic photosensitive member 10, the charging unit 12, the developing unit 14, the transfer unit 15, the fixing unit 16, the cleaning unit 17, the discharging unit 18, and the like in the image forming apparatus X to control the operations of the components in image forming processing. This control means includes operation information receiving means including, for example, a mouse and a keyboard, image signal receiving means including, for example, a CD-ROM drive, a modem, and the like, the means being not illustrated in the figures. The control means controls the operations of the components in accordance with an operation instruction and an image signal received from the outside to form an image based on the received image signal.

The developing unit 14 shown in FIG. 5 develops an electrostatic latent image on the electrophotographic photosensitive member 10 to form a toner image. The developing unit 14 holds a developer and also includes a developing sleeve 14*a*.

The developing sleeve 14*a* is a component for carrying the developer to a development area between the electrophotographic photosensitive member 10 and the developing sleeve 14*a*.

In the developing unit 14, toner frictionally charged by the developing sleeve 14*a* is carried in form of a magnetic brush adjusted so as to have bristles with a constant length and this toner develops an electrostatic latent image in the development area between the electrophotographic photosensitive 10 and the developing sleeve 14*a*, thus forming a toner image. When the image is formed by standard development, a charging polarity of the toner image is opposite to the charging polarity of the surface of the electrophotographic photosensitive member 10, and when the image is formed by reversal development, the charging polarity thereof is the same as the charging polarity of the surface of the electrophotographic photosensitive member 10.

The transfer unit 15 is a component for transferring a toner image to a recording sheet P conveyed to a transfer area between the electrophotographic photosensitive member 10 and the transfer unit 15 and includes a transfer charger 15*a* and a detach charger 15*b*. In this transfer unit 15, a non-recording surface of the recording sheet P is charged to a polarity opposite to that of the toner image in the transfer charger 15*a*. Electrostatic attraction between the charged electrical charge and the toner image causes the toner image to be transferred onto the recording sheet P. In the transfer unit 15, furthermore, the rear surface of the recording sheet P is AC-charged in the detach charger 15*b* substantially simultaneously with the transfer of the toner image, so that the recording sheet P is immediately detached from the surface of the electrophotographic photosensitive member 10.

In addition, as the transfer unit 15, a transfer roller which is driven in accordance with the rotation of the electrophotographic photosensitive member 10 and is placed relative to the electrophotographic photosensitive member 10 with an extremely small distance (generally, equal to or less than 0.5 mm) therebetween may be used. In this case, the transfer roller is constructed such that, for example, a DC power source applies a transfer voltage to the transfer roller so that a toner image on the electrophotographic photosensitive member 10 is attracted onto the recording sheet P. In the use of such a transfer roller, a transfer material separating unit, such as the detach charger 15*b*, can be omitted.

The fixing unit 16 is a component for fixing a toner transferred to a recording sheet P and includes a pair of fixing rollers 16*a* and 16*b*. In the fixing unit 16, the recording sheet P is allowed to pass through the pair of fixing rollers 16*a* and 16*b*, so that the toner image is fixed to the recording sheet P by heat, pressure, and the like. In the image forming apparatus X, an image is recorded on the recording sheet P in that manner.

The cleaning unit 17 is a component for removing toner remaining on the surface of the electrophotographic photosensitive member 10 and includes a cleaning blade 17*a*. In this cleaning unit 17, the cleaning blade 17*a* scrapes and collects toner remaining on the surface of the electrophotographic photosensitive member 10. The toner collected in the cleaning unit 17 may be recycled into the developing unit 14.

The discharging unit 18 is a component for removing charge on the surface of the electrophotographic photosensitive member 10. This discharging unit 18 is constructed so as to remove charge on the surface of the electrophotographic photosensitive member 10 by, for example, light emission. By the operations of the cleaning unit 17 and the discharging unit 18, the surface of the electrophotographic photosensitive member 10 is reset to an initial state (namely, a state in which toner does not adhere to the surface and the surface is not charged) and it is again shifted for image formation between the charging unit 12 and the fixing unit 16. In the image forming apparatus X, as described above, images are formed and recorded onto recording sheets P fed successively.

In the image forming apparatus X according to the present embodiment, as described above, the protrusions 31*a* and 31*b* of the support member 31 are in contact with the reference member 13A on the apparatus side in the space between the principal surface of the circuit board 33A on which the light-emitting devices 34*a* are placed and the electrophotographic photosensitive member 10. Specifically, the reference member 13A on the apparatus side is in contact with the protrusions 31*a* and 31*b* on the optical printer head 30 side between the electrophotographic photosensitive member 10 and the optical printer head 30, thus setting the position of the optical printer head 30 in the image forming apparatus X. Consequently, the image forming apparatus X is constructed relatively compact.

In the above-described embodiment, the cross section in the protruding direction of each the protrusions 31*a* and 31*b* in the support member 31 is substantially cylindrical-shaped. In the present invention, the shape of this protrusion is not particularly limited. For example, the shape of the cross section in the protruding direction may be a rectangle, a triangle, or another polygon having five or more vertices.

In addition, in the present invention, the horizontal position determining portion is not limited to the structure including the positioning hole. For example, positioning projections projecting from the optical axis position determining surfaces of the protrusions of the support member may be provided and the positioning projections may be fitted into recesses provided in the reference member on the image forming apparatus side to determine the above-described horizontal positions of the image forming positions of light in the image forming apparatus.

In addition, in the above-described embodiment, the external force applying mechanism 138 of the optical printer head 30 includes the two springs 13Ba and the springs 13Bb apply external forces to the external force application regions in the optical printer head 13. It is unnecessary to allow the external force applying mechanism included in the image forming apparatus of the present invention to include such springs. The external force applying mechanism included in the image forming apparatus of the present invention is not particularly limited.

Figure 7:
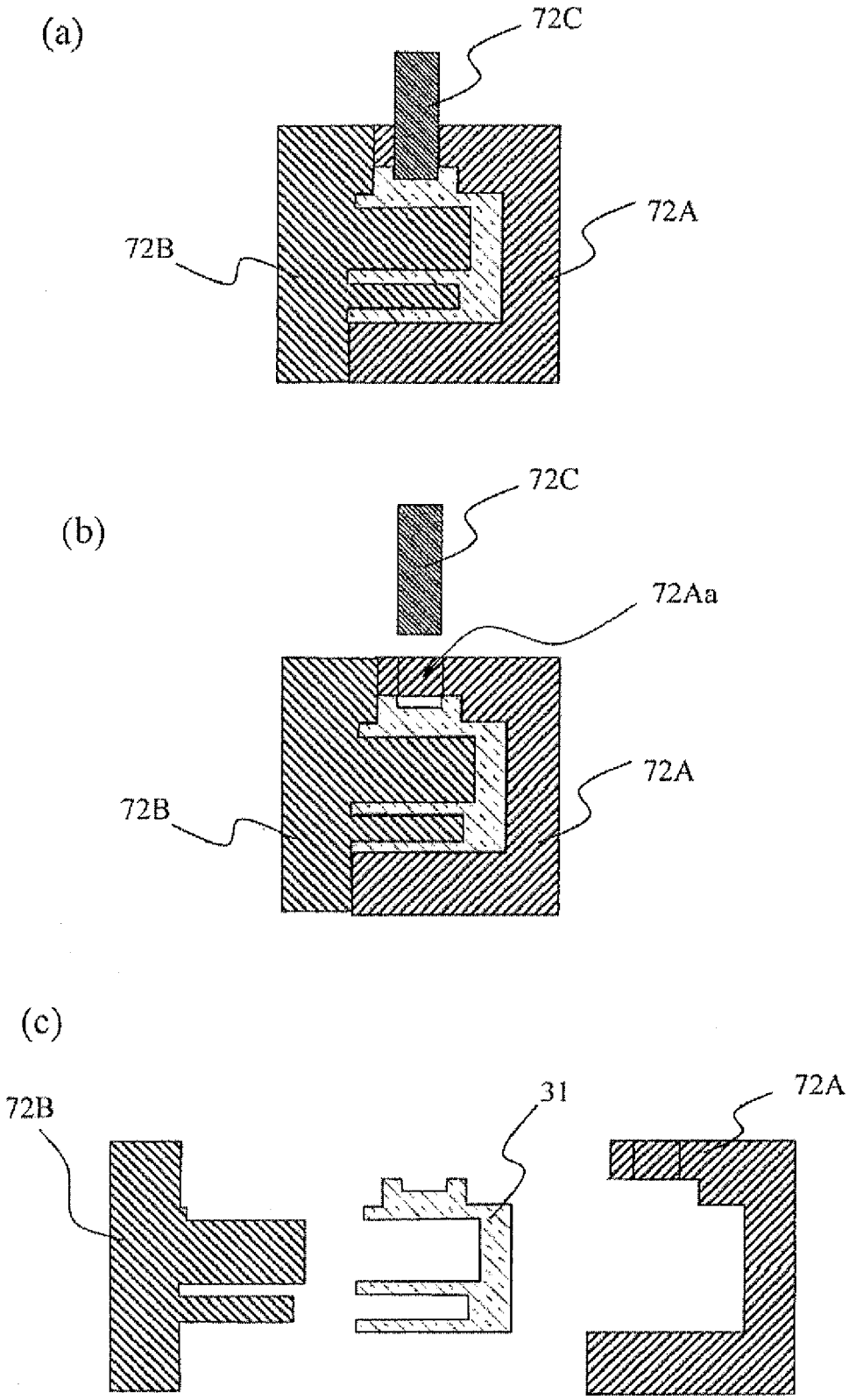
FIG. 7 is, a schematic cross-sectional view illustrating an example of a method of manufacturing the optical printer head of the present embodiment.

The support member 31 in the present embodiment can be made, for example, as follows. Referring to FIG. 7, the support member 31 can be made by a molding process using two molds 72A and 72B and slide pins 72C. Specifically, as shown in FIG. 7(*a*), a resin material is injected into a space formed by combining the two molds 72A and 728 and the resin material is solidified, thus forming the single support member 31 made of the resin material. In injecting the resin material, the protrusions 31*a* are also integrally molded. One end portions of the slide pins 72C are placed in portions corresponding to the positioning holes 312*a* and 312*b*. The mold 72A has through holes 72Aa through which the slide pins 72C can be inserted. The resin material is injected while the slide pins 72C are placed in the through holes 72Aa.

After the resin material is solidified, as shown in FIG. 7(*b*), each slide pin 72C is removed from the through hole 72Aa. By removing the slide pins 72C, as shown in FIG. 7(*c*), the molds 72A and 72B can be separated from the molded support member 31 without any physical barrier, such as a catch. By using the slide pins as described above, the support member having recesses and protrusions can be easily made by molding a resin material.

The present invention is not limited to the image forming apparatus using the electrophotographic method but can also be applied to an image forming apparatus of irradiating a photosensitive medium, such as photosensitive paper, with light to form an image in the photosensitive medium. In addition, image formation is not limited to that on a drum-shaped photosensitive member. An image may be formed on, for example, a film-shaped photosensitive member conveyed along the same level.

Although the optical printer head and the image forming apparatus of the present invention have been described above, the optical printer head and the image forming apparatus of the present invention are not limited to the above-described embodiment. It is a matter of course that various changes and modifications can be made without departing from the spirit and scope of the present invention.

The invention claimed is:

1. An optical printer head comprising:

a base;

a light-emitting device array mounted on the base;

a lens array placed above the light-emitting device array; and a support member including a base bonding surface to which the base is bonded and a lens array bonding surface to which the lens array is bonded, wherein the support member comprises a through hole penetrating at the base bonding surface, and the base is bonded to the base bonding surface through an adhesive member and a part of the adhesive member is attached to an inner surface of the through hole.

2. The optical printer head according to claim 1, wherein the through hole communicates with the outside.

3. The optical printer head according to claim 1, wherein the thickness of the adhesive member is greater than a maximum height $R_{max}$ of the base bonding surface.

4. The optical printer head according to claim 1, wherein the base comprises a circuit board on which the light-emitting device array is mounted and a plate-shaped member on which the circuit board is bonded, and the rigidity of the plate-shaped member is higher than those of the circuit board and the support member.

5. The optical printer head according to claim 1, wherein the support member comprises resin.

6. An optical printer head comprising: a base;

a light-emitting device array mounted on the base; a lens array placed above the light-emitting device array; and a support member including a base bonding surface to which the base is bonded and a lens array bonding surface to which the lens array is bonded, wherein the support member comprises a positioning hole for determining an attachment position of the optical printer head to an external member, and the positioning hole is placed on the upper side of a mounting surface of the base on which the light-emitting device array is mounted.

7. The optical printer head according to claim 6, wherein the support member comprises a positioning protrusion protruding in the direction perpendicular to the mounting surface, and the positioning hole is formed in the positioning protrusion.

8. The optical printer head according to claim 6, wherein the support member further comprises a plurality of positioning holes and, in at least one of the positioning holes, a virtual straight line passing through the at least one positioning hole and extending in the direction perpendicular to the mounting surface intersects the base.

9. The optical printer head according to claim 6, further comprising a plurality of light-emitting device arrays, wherein the base has an elongated shape, the plurality of the light-emitting device arrays are aligned in the lengthwise direction of the base on the mounting surface, and the positioning hole is placed in the outside of an area where the light-emitting device arrays are aligned, in the lengthwise direction.

10. The optical printer head according to claim 6, further comprising:

a controller controlling driving of the light-emitting device array, the controller being placed on the mounting surface of the base; and a connector connected to the controller, the connector being placed on a surface of the base opposite the mounting surface;

wherein the connector is placed in the outside of both of the positioning hole and an area where the light-emitting device array is placed, in the lengthwise direction.

11. The optical printer head according to claim 6, wherein the positioning hole determines a position of the optical printer head by receiving at least part of an external reference member.

12. An image forming apparatus comprising:

the optical printer head according to claim 6;

a cylindrical photosensitive member;

a reference member that determines a position of the support member by inserting at least part thereof into the positioning hole of the optical printer head; and an external force applying mechanism which applies an external force in the direction along the optical axes of the lenses while the reference member is inserted in the positioning hole, wherein the reference member is inserted in the positioning hole between the photosensitive member and the base.

13. The image forming apparatus according to claim 12, wherein the external force applying mechanism is in contact with an area of the support member which is positioned on the rear surface opposite the base bonding surface and corresponds to the positioning hole.

* * * * *